US005691600A

United States Patent [19]

Moyer et al.

[11] Patent Number: 5,691,600

[45] Date of Patent: Nov. 25, 1997

[54] EDGE ELECTRON EMITTERS FOR AN ARRAY OF FEDS

[75] Inventors: Curtis D. Moyer, Phoenix; Jeffery A. Whalin, Fountain Hills; Wayne Morrow, Phoenix; Steven A. Voight, Gilbert, all of Ariz.

[73] Assignee: Motorola, Schaumburg, Ill.

[21] Appl. No.: 489,017

[22] Filed: Jun. 8, 1995

[51] Int. Cl.[6] ..... H01J 1/66

[52] U.S. Cl. ..... 313/497; 313/309; 313/308; 313/311; 313/351

[58] Field of Search ..... 313/306, 310, 313/309, 311, 346 R, 351, 495–497, 308

[56] References Cited

U.S. PATENT DOCUMENTS 5,142,184 8/1992 Kane ..... 313/309
5,214,347 5/1993 Gray ..... 313/310 X
5,430,348 7/1995 Kane et al. ..... 313/309
5,465,024 11/1995 Kane ..... 313/351 X
5,502,348 3/1996 Moyer et al. ..... 313/310
5,545,946 8/1996 Wiemann et al. ..... 313/497

*Primary Examiner*—Sandra L. O'Shea
*Assistant Examiner*—Ashok Patel
*Attorney, Agent, or Firm*—Eugene A. Parsons

[57] ABSTRACT

A plurality of edge emitters in a FED array include a plate shaped substrate having parallel, laterally spaced apart grooves formed in a first surface and parallel, laterally spaced apart grooves formed in the opposite surface so that each second groove crosses each first groove at an angle. The combined depths of the grooves is greater than the thickness of the plate substrate so that an opening is formed through the substrate at each point where a second groove crosses a first groove. Gate metal is deposited on the surfaces in the openings and emitter material is deposited on the lands of the first surface to form FED emitters in each opening.

10 Claims, 10 Drawing Sheets

100

EDGE ELECTRON EMITTERS FOR AN ARRAY OF FEDS

FIELD OF THE INVENTION

The present invention pertains to arrays of field emission devices for flat panel displays and more specifically to a substrate for the formation of an array of field emission devices.

BACKGROUND OF THE INVENTION

A variety of schemes for utilizing field emission devices (FEDs) to form flat panel displays have been proposed in the past. Most of these schemes use arrays of the conical tips generally referred to as Spindt tips. However, these schemes were generally so complicated to fabricate or so impractical that they could not be used to manufacture, either practically or reliably, flat panel displays at a reasonable price. Further, Spindt tips are generally unreliable and very difficult to make with sufficient consistency to prevent a variety of problems including shorts between emitter tip and grid, too much grid current, deteriorating tips, exploding tips, etc.

More recently, practical embodiments of a flat panel display have been disclosed in two copending U.S. Patent Applications, both of which are assigned to the same assignee. The first patent application is entitled "Field Emission Display Employing a Peripheral Diamond Material Edge Electron Emitter", Ser. No. 08/168,301, filed on Dec. 17, 1993, now U.S. Pat. No. 5,545,946 and the second patent application is entitled "Ballistic Charge Transport Device with Integral Active Containment Absorption Means", Ser. No. 08/169, 232, filed on Dec. 20, 1993 now U.S. Pat. No. 5,502,348. Information pertaining to the operation of the FEDs and the overall array disclosed in these patent applications is incorporated herein by reference.

Generally, the above described patent applications describe an array of edge emitter FEDs formed on a dielectric substrate having an array of holes formed therethrough. Forming these holes in the required position and the required size can be very difficult and costly. Further, forming the FEDs on the substrate after the holes are formed generally requires several deposition and masking steps which are difficult and are costly to achieve the required registration of each subsequent step.

Accordingly it would be highly desirable to provide a substrate, and method of fabricating the substrate, which is simple to manufacture and use.

It is a purpose of the present invention to provide a new and improved supporting substrate for an array of edge emitting field emission devices.

It is another purpose of the present invention to provide a new and improved supporting substrate for an array of edge emitting field emission devices which is relatively simple to manufacture and use.

It is still another purpose of the present invention to provide a new and improved supporting substrate for an array of edge emitting field emission devices which is relatively inexpensive to manufacture and which can be used in a completely self-aligning process.

It is still another purpose of the present invention to provide a new and improved array of edge emitting field emission devices in which ballasting is relatively easily incorporated to provide uniform current distribution throughout the array.

It is a further purpose of the present invention to provide a new and improved supporting substrate for an array of edge emitting field emission devices in which a plurality of the substrates can be stacked to provide the required spacing and support.

SUMMARY OF THE INVENTION

The above problems and others are at least partially solved and the above purposes and others are realized in a plurality of edge emitters in a FED array including a plate shaped substrate having parallel, laterally spaced apart grooves formed in a first surface and parallel, laterally spaced apart grooves formed in the opposite surface so that each second groove crosses each first groove at an angle. The combined depths of the grooves is greater than the thickness of the plate substrate so that an opening is formed through the substrate at each area or region where a second groove crosses a first groove. Gate metal is deposited on the surfaces in the openings and emitter material is deposited on the lands of the first surface to form FED emitters in each opening.

The above problems and others are at least partially solved and the above purposes and others are further realized in a method of fabricating a supporting substrate for a plurality of edge electron emitters for an array of field emission devices, including the steps of providing a plate shaped, dielectric substrate having a first and a second planar surface positioned in parallel opposed relationship with a selected thickness therebetween, forming a plurality of parallel, laterally spaced apart first grooves in the first planar surface to a first depth, and forming a plurality of parallel, laterally spaced apart second grooves in the second planar surface to a second depth, positioning the second grooves so that each second groove crosses each first groove at an angle to the first grooves, the first and second depths combined being greater than the thickness of the plate substrate so that an opening is formed through the substrate at each point where a second groove crosses a first groove.

A specific example of a method of using the above described supporting substrate includes the further steps of depositing a layer of gate metal on the second side surfaces of the plurality of second grooves and on the first side surfaces of the plurality of first grooves in each of the openings, and depositing emitter material on each of the lands so as to form an edge emitter in conjunction with the layer of gate metal on the first side surfaces of the plurality of first grooves in each of the openings.

BRIEF DESCRIPTION OF THE DRAWINGS

Referring to the drawings.

DESCRIPTION OF THE PREFERRED EMBODIMENTS

Figure 1:
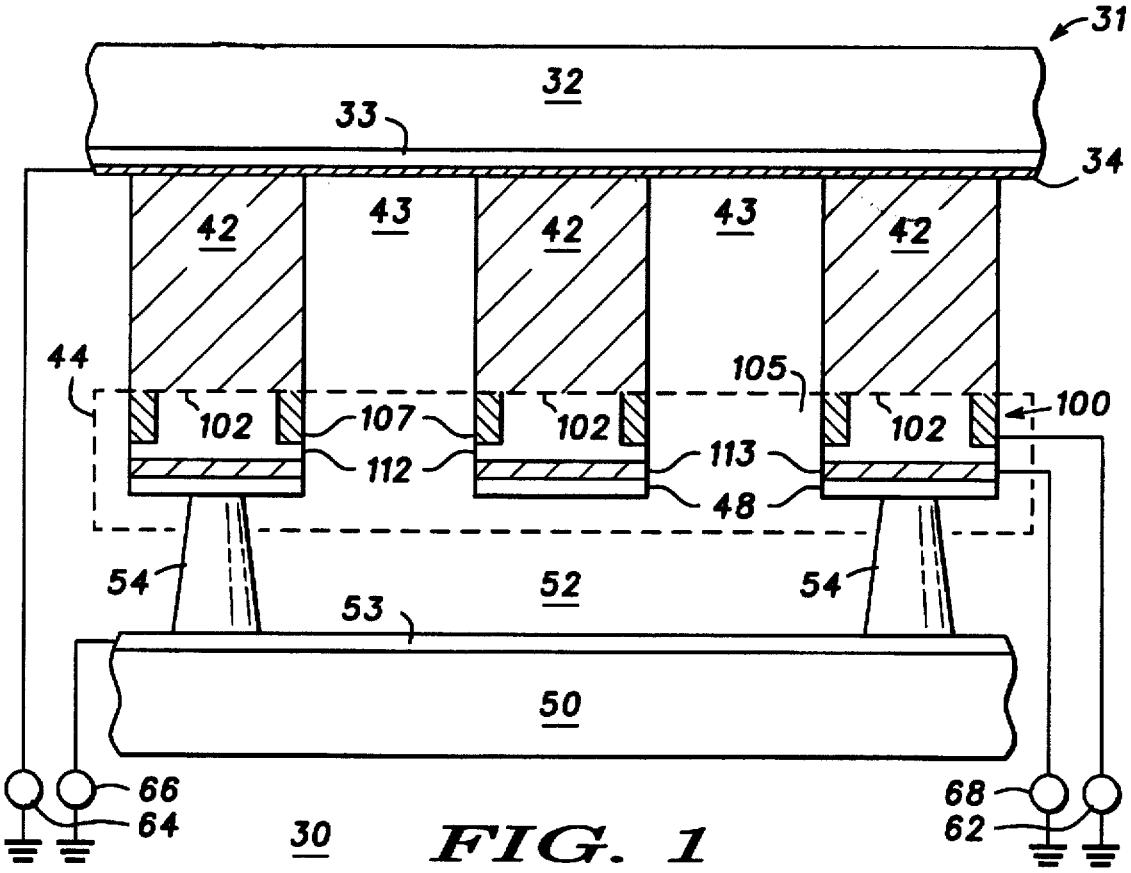
FIG. 1 is a simplified cross-sectional view of a flat panel display in accordance with the present invention, portions thereof broken away.

Referring now to FIG. 1 there is depicted a partial cross-sectional representation of an embodiment of a flat image display assembly 30 incorporating a two dimensional array of edge emitters in accordance with the present invention. A substantially optically transparent viewing screen assembly 31 includes a transparent screen 32 having deposited thereon an energy conversion layer 33 of material such as a cathodoluminescent material layer and a conductive anode layer 34. An interspace insulating layer 42, having interspace apertures 43 defined therethrough and which apertures define an interspace region, is disposed in this specific embodiment on conductive anode layer 34.

A plurality of electron emitters positioned in a two dimensional array, illustrated in a simplified schematic representation and delineated generally within a depicted dashed line box 44, are defined by a supporting substrate 100, which substrate 100 includes substrate openings 105 defined therethrough. An emitter 113 for emitting electrons is disposed on an insulating portion 112 of supporting substrate 100 and a non-conductive layer 48 is disposed on electron emitter 113. A conductive gate layer 107 disposed on the sides of supporting substrate 100 within substrate openings 105. Electron emitter 113 may preferentially be comprised of one of, for example, diamond, diamond-like carbon, non-crystalline diamond-like carbon, aluminum nitride, and any other electron emissive material exhibiting surface work function of less than approximately 1.0 electron volts.

For the embodiment depicted in a surface 102 of FIG. 1 supporting substrate 100 is disposed on interspace insulating layer 42 such that substrate openings 105 are in substantial registration with interspace apertures 43. It should also be noted that supporting substrate 100 separates portions of conductive gate layer 107, so that conductive gate layer 107 is divided into opposing surfaces on opposite sides of substrate openings 105. For control of separate electron emitters, rows or columns of the opposing surfaces are electrically connected, as will be explained in more detail presently.

A backplane 50 is distally disposed with respect to supporting substrate 100 and defines an evacuated region 52 therebetween. A getter material layer 53 is disposed on backplane 50 in opposition to supporting substrate 100. Spacers 54 are disposed in region 52 and in operable contact with insulating layer 48 on supporting substrate 100 and getter material layer 53 such that upon evacuation of region 52 image display assembly 30 will not collapse. It should be understood that getter material layer 53 could be patterned, for example, so that spacers 54 is disposed on backplane 50, rather than getter material layer 53. For purposes of this disclosure and because getter material layer 53 is generally very thin, in either embodiment it will be considered that backplane 50 is supported by spacers 54, or vice versa.

Referring once again to FIG. 1 there are depicted a number of electrical potential sources 62, 64, 66 and 68 each operably connected to one or more elements of image display assembly 30. For the purposes of the present discussion, and by no means as a limitation of operation, each of sources 62, 64, 66 and 68 may be operably connected to a reference potential such as, for example only, ground potential. Potential source 62 is operably connected between conductive gate layer 107 and the reference potential. Potential source 64 is operably connected between conductive anode 34 of viewing screen assembly 31 and the reference potential. Potential source 66 is operably connected between getter material layer 53 and the reference potential. Potential source 68 is operably connected between electron emitter 113 and the reference potential.

During operation of image display assembly 30, electrons emitted from electron emitter 113 traverse the extent of substrate openings 105 and interspace apertures 43 to impinge on cathodoluminescent layer 33 wherein the electrons excite photon emission. Potential source 62 in concert with potential source 68 functions to control emission of electrons. Potential source 64 provides an attractive potential which establishes a requisite electric field within interspace apertures 43 and provides for collection of the emitted electrons. Potential source 66 provides an attractive potential for ionic constituents which are randomly disposed within any of interspace apertures 43, substrate openings 105, or region 52. Coincidentally, source 66 modifies emitted electron trajectories by providing an opposing potential, with respect to any negatively charged emitted electrons, at getter material layer 53.

Potential sources 62 and 68 are selectively applied to desired portions of an array of picture elements in a manner, well known in the art, which provides for controlled electron emission from associated parts of electron emitter 113. Such controlled electron emission provides for a desired image or plurality of images observable at viewing screen assembly 31.

Figure 2:
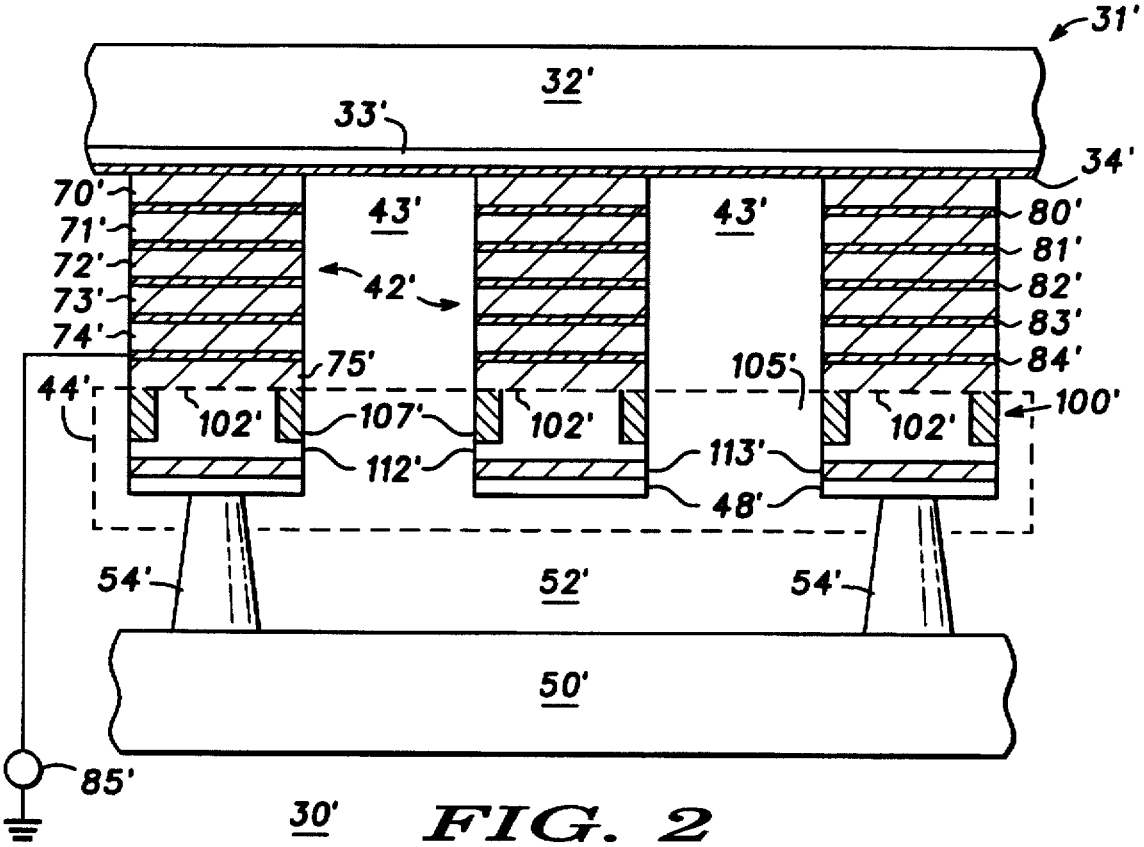
FIG. 2 is a view similar to FIG. 1 of a modified flat panel display in accordance with the present invention.
Figure 3:
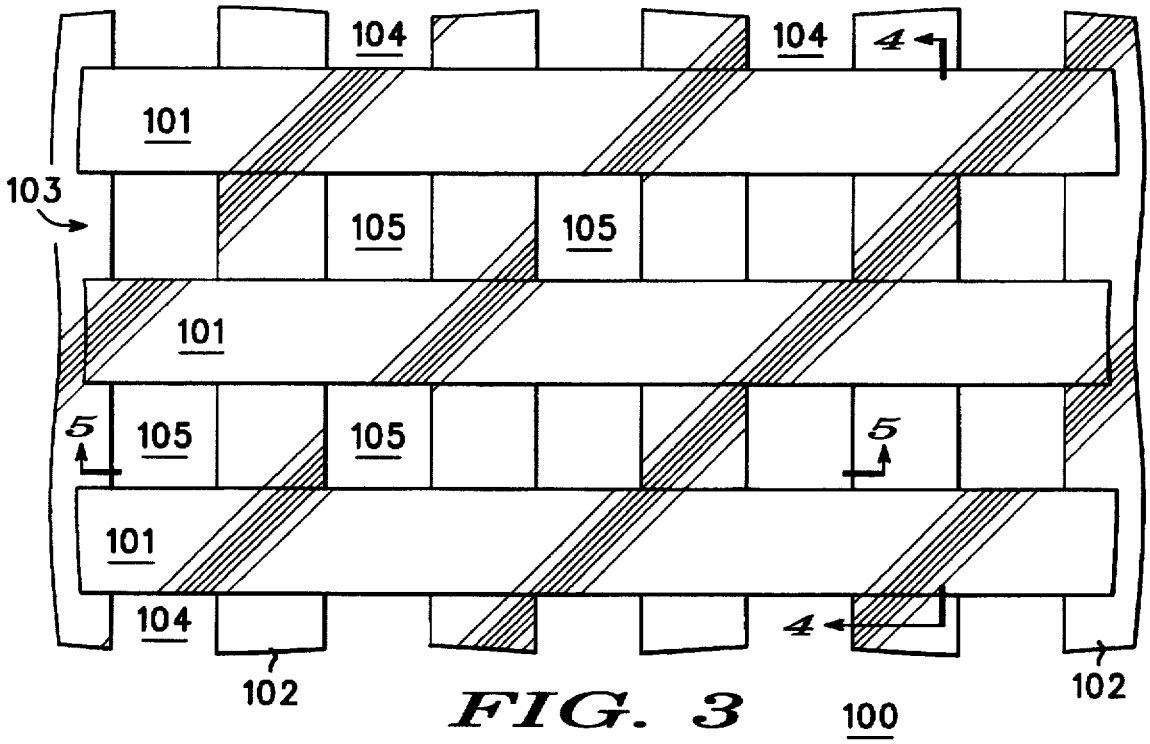
FIG. 3 is a view in top plan of a supporting substrate in accordance with the present invention.
Figure 4:
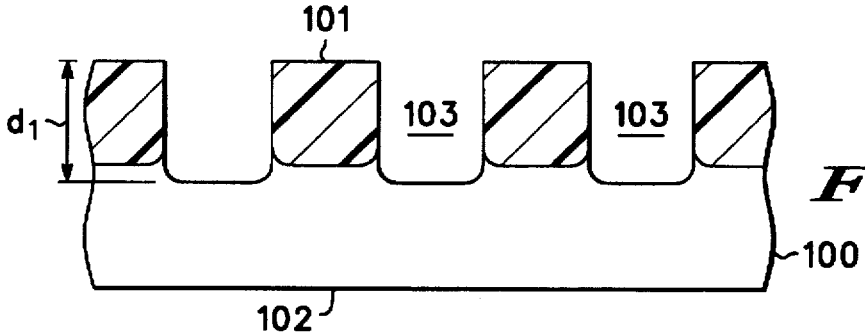
FIG. 4 is a cross-sectional view of the supporting substrate of FIG. 3, as seen from the line 4—4 in FIG. 3.

A partial cross-sectional representation of another embodiment of a flat image display assembly 30' in accordance with the present invention, is illustrated in FIG. 2. Features previously described in conjunction with FIG. 1 are similarly referenced herein, with a prime added to all of the numbers to indicate the different embodiment. As further depicted in FIG. 2, interspace insulating layer 42' is comprised of a stacked plurality of insulating layers 70'–75' each of which may be similar to supporting substrate 100 (as depicted in FIGS. 3, 4 and 23, and as will be described in more detail in conjunction with FIG. 22), and each of which layers has associated therewith a surface on which is deposited a conductive layer 80'–84' such as, for example only, molybdenum, aluminum, titanium, nickel, or tungsten. Thus, individual conductive layers 80'–84' are sandwiched between adjacent insulating layers 70'–75'. Although the depiction of FIG. 2 includes six insulating layers with five conducting layers sandwiched therebetween, it is anticipated that fewer or more such conducting and/or insulating layers may be employed to realize interspace insulating layer 42'. It is further anticipated that some or all of insulating layers 70'–75' may be provided without a conductive layer disposed thereon.

Also depicted in FIG. 2 is an electrical potential source 85', such as a voltage source, operably connected between a conductive layer, in this representative example conductive layer 84', and the reference potential Source 84' is selected to provide a desired modification to the electric field within interspace apertures 43' to affect emitted electron velocities in transit to anode 34'. Other electrical potential sources, not depicted, may be similarly employed at other of conductive layers 80'–83' if desired.

Turning now to FIG. 3, a view in top plan of a supporting substrate 100, portions thereof broken away, in accordance with the present invention is illustrated. An isometric view of supporting substrate 100 is illustrated in FIG. 23 to aid in understanding the structure. Supporting substrate 100 and the following process and components form a complete embodiment of the two dimensional array illustrated in dashed lines boxes 44 or 44' (FIGS. 1 and 2), previously described in a simplified schematic representation. Also, for a better understanding of supporting substrate 100, FIGS. 4 and 5 illustrate cross-sectional views as seen from lines 4—4 and 5—5, respectively, in FIG. 3.

Supporting substrate 100 is a generally plate-shaped, dielectric substrate formed of glass or any other suitably rugged dielectric material with spaced apart, parallel planar surfaces 101 and 102. A plurality of parallel, laterally spaced apart grooves 103 are formed in planar surface 101 to a selected depth $d_1$. Also, a plurality of parallel, laterally spaced apart grooves 104 are formed in planar surface 102 to a selected depth $d_2$. Grooves 104 are positioned so that each groove 104 crosses each groove 103 at an intersecting angle to grooves 103, which in this embodiment is 90°. The combined total depth of $d_1$ and $d_2$ should be greater than the thickness of supporting substrate 100 so that an opening 105 is formed through supporting substrate 100 at each point or area where a groove 104 intersects a groove 103. Thus, supporting substrate 100 defines a two dimensional array of openings 105 positioned in rows and columns.

In the present specific embodiment, grooves 103 and 104 are formed by saw cutting supporting substrate 100 from surface 101 and then from surface 102. To minimize chipping and other defects during the sawing operation and to provide relatively sharp and well defined edges, especially if supporting substrate 100 is a glass plate, surfaces 101 and 102 of supporting substrate 100 are first coated with a layer of metallic or organic material. The coating may also be used as a self-aligned etch mask in the event that any etching is required to improve the definition of the bottoms of grooves 103 and 104 (reduce rounding, etc.). After grooves 103 and 104 are formed in supporting substrate 100, the coating is removed by any convenient process, generally depending upon the type of material used in the coating.

Figure 6:
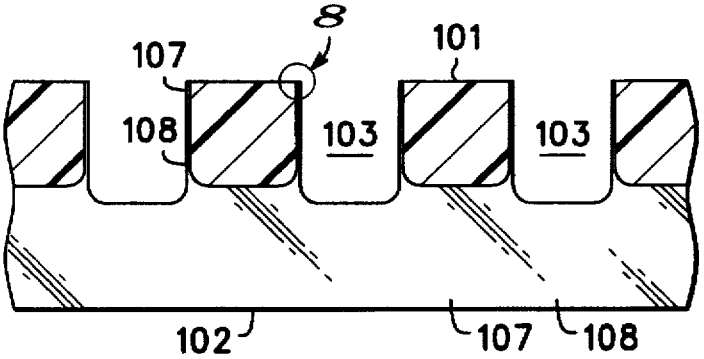
FIGS. 6–20 are alternately cross-sectional views, similar to FIGS. 4 or 5, and greatly enlarged partial views illustrating various sequential steps in the fabrication of an array of field emission devices utilizing the supporting substrate of FIG. 3.
Figure 7:
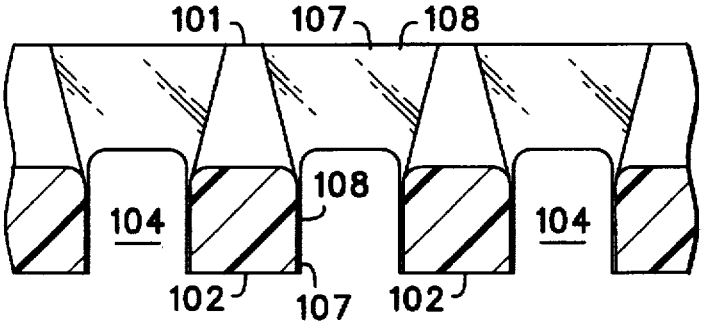
Figure 5:
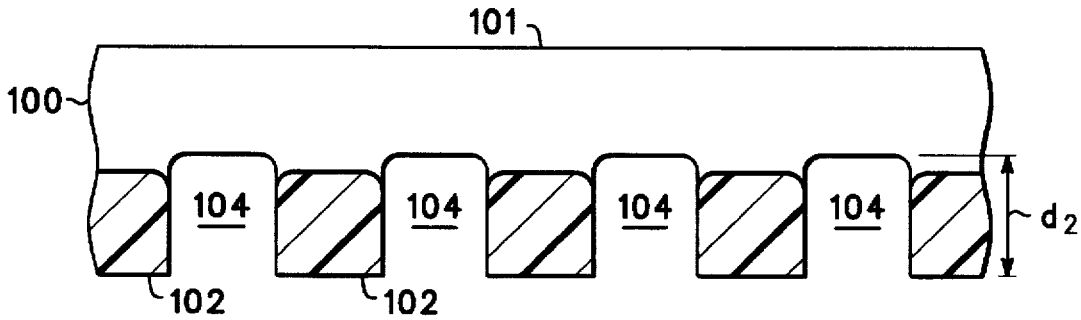
FIG. 5 is a cross-sectional view of the supporting substrate of FIG. 3, as seen from the line 5—5 in FIG. 3.

Referring to FIGS. 6 and 7, cross-sectional views of supporting substrate 100, similar to FIGS. 4 and 5, respectively, are provided to illustrate another step in the process of fabricating a plurality of edge electron emitters. A layer 107 of gate metal is deposited on the sides of grooves 104 and 103 from a source (not shown) beyond surface 102. This deposition can be performed by any well known method, such as sputtering, etc. Layer 107 forms a continuous layer on the sides of grooves 104 (see FIG. 6) but, because surface 102 forms a shadow mask for the deposition, interruptions occur in layer 107 on the sides of grooves 103 (see FIG. 7). As will be explained in more detail presently, interrupted layer 107 on the sides of grooves 103 form extraction electrodes for the edge electron emitters.

Figure 8:
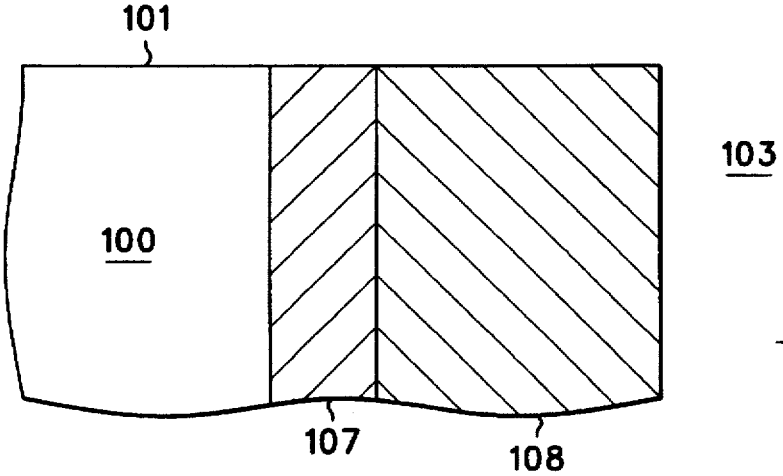

After depositing layer 107, surfaces 101 and 102 are polished to remove any gate metal that may have been formed thereon. The remaining gate metal in layer 107 forms a continuous conductor on the sides of grooves 104 and individual extraction electrodes on the sides of grooves 103, which extraction electrodes are connected to the continuous conductors. In this specific embodiment continuous conductors (layer 107) serve as row connections for the two dimensional array of electron emitters. A relatively thick layer 108 of sacrificial metal or other material is then deposited onto layer 107 to provide spacing and protection for gate layer 107, as will become apparent presently. A greatly enlarged view of an edge portion of one groove 103 (from FIG. 6) is shown in FIG. 8 to illustrate the relationship of layers 107 and 108 to surface 101.

Figure 9:
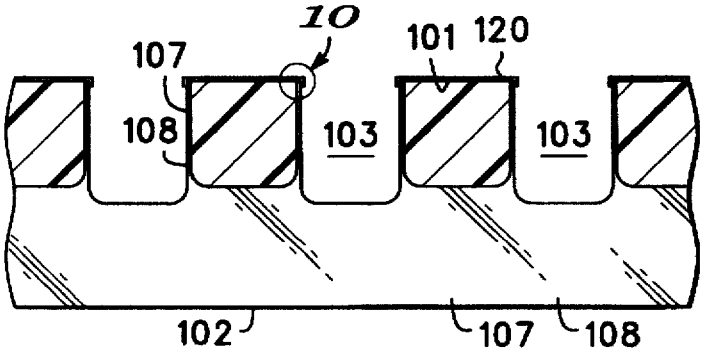

Referring to FIG. 9 an elevational view of supporting substrate 100, as seen from the right side of FIG. 3, is shown to illustrate further steps in the process of fabricating a plurality of edge electron emitters. A thin insulating layer 112, generally comprised of some convenient material such as an oxide, is formed on surface 101 of supporting substrate 100 by some convenient method, such as plasma enhanced chemical vapor deposition (PECVD), evaporating, sputtering, or the like. Insulating layer 112, which may be on the order of 1 μm thick, is utilized to insulate and space an emitter 113 from the extraction gate layer 107, as will be seen presently.

Emitter 113 is formed on insulating layer 112 by some convenient method, such as PECVD, evaporating, sputtering, or the like. Emitter 113 maybe a single layer of conductive material or any of the multi-layer emitter assemblies disclosed in copending U.S. patent application entitled "Field Emission Display Employing a Peripheral Diamond Material Edge Electron Emitter", Ser. No. 08/168,301, filed on Dec. 17, 1993. Also, the emitting layer may be diamond-like carbon material, aluminum nitride, cesium, or any other low work function material (i.e. <1.5 volts). In this specific embodiment, emitter 113 includes a metal layer 114, a layer 115 of diamond-like carbon material, and another metal layer 116.

If ballasting is not required, one or both of metal layers 114 and 116 are connected as the emitter leads (column connections). In this case, sacrificial layer 108 is removed at this time and emitter 113 and later 112 are clipped off so as to be substantially flush with the outer edge of extraction gate layer 107. The edges of layer 115 facing into grooves 103 serve as emitting surfaces, and the overall structure forms a two dimensional matrix (row/column) of edge emitting cold cathode electron sources or field emission devices. When supporting substrate 100 is incorporated into flat image display apparatus 30, as supporting substrate 44, a matrix addressable cold cathode display is provided.

Figure 10:
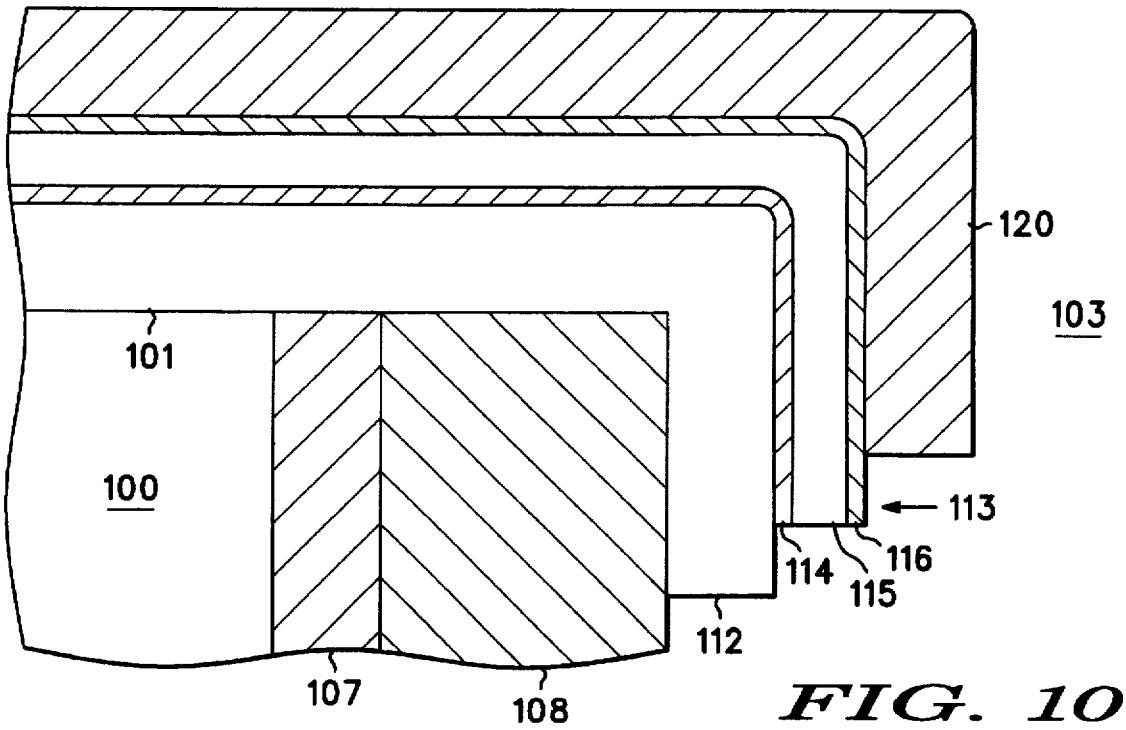

If ballasting of emitter 113 is desired, at least layer 116, or both layers 116 and 114, can be formed of a resistive material, such as doped (α) silicon. A conductive layer 120, of some convenient material such as aluminum, is then formed over layer 116 of emitter 113 by some convenient method, such as patterning, evaporating, sputtering, or the like. Depending upon the method utilized to form layer 112, emitter 113 and layer 120, it may be desirable to form masking layers on exposed surfaces other than surface 101, which masking layers and additional materials are later removed, to ensure a final assembly somewhat similar to that shown in FIG. 10, with or without the overhang on the sides.

Figure 12:
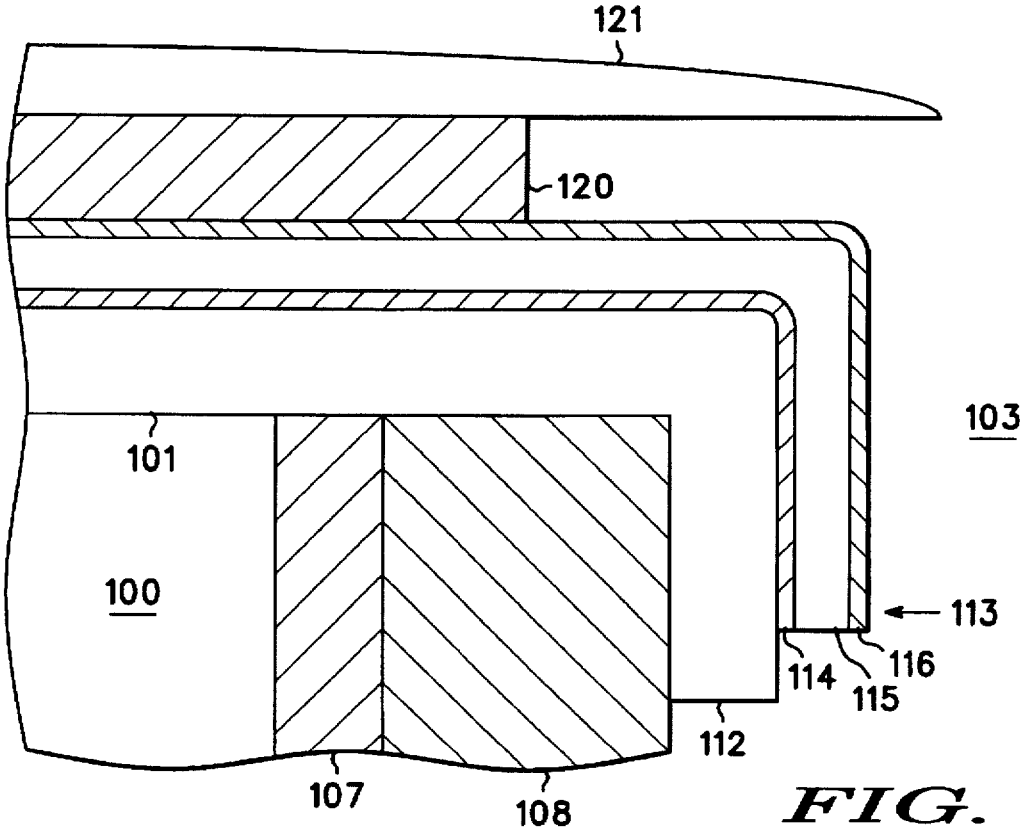
Figure 11:
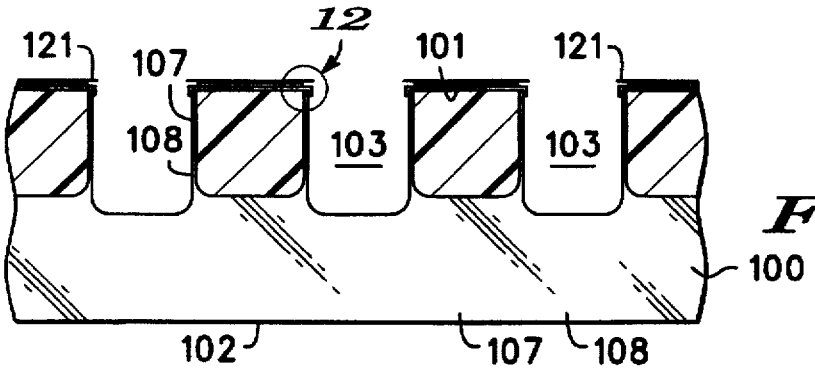
Figure 13:
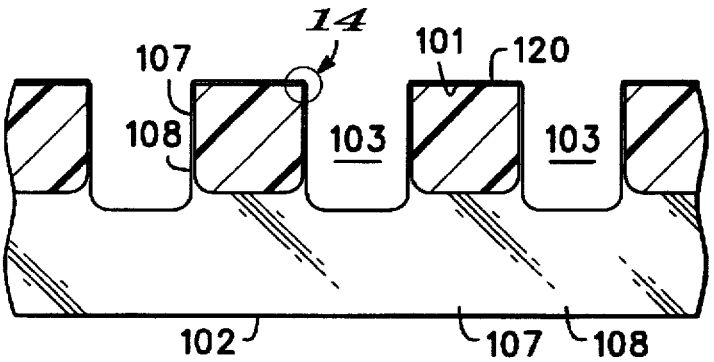
Figure 14:
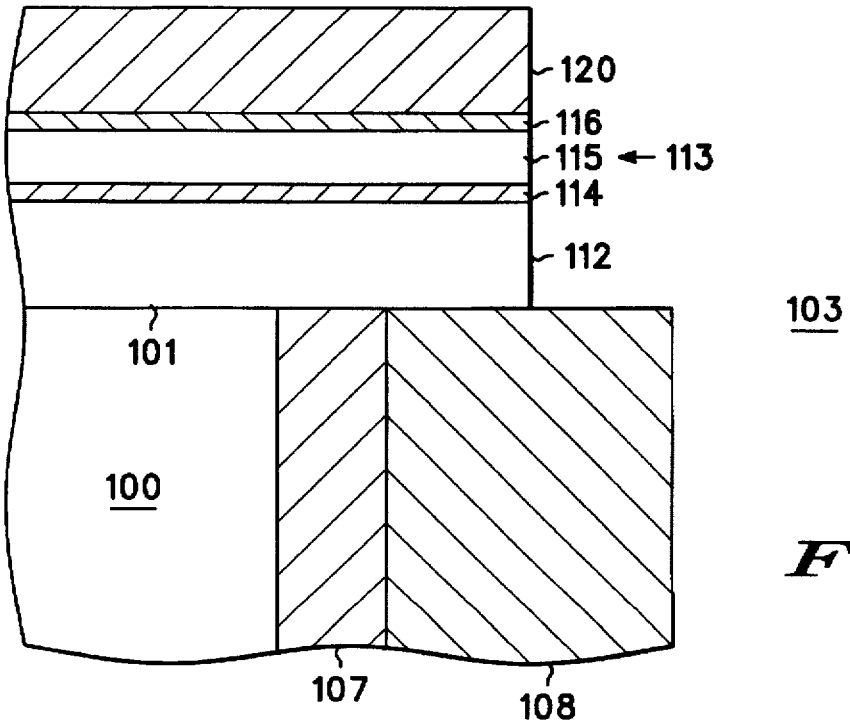
Figure 15:
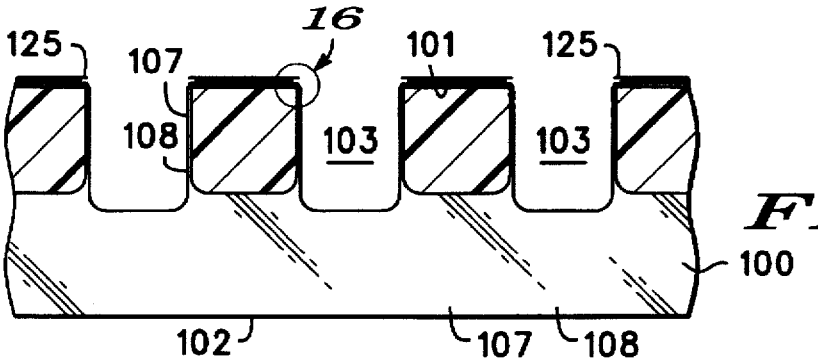
Figure 16:
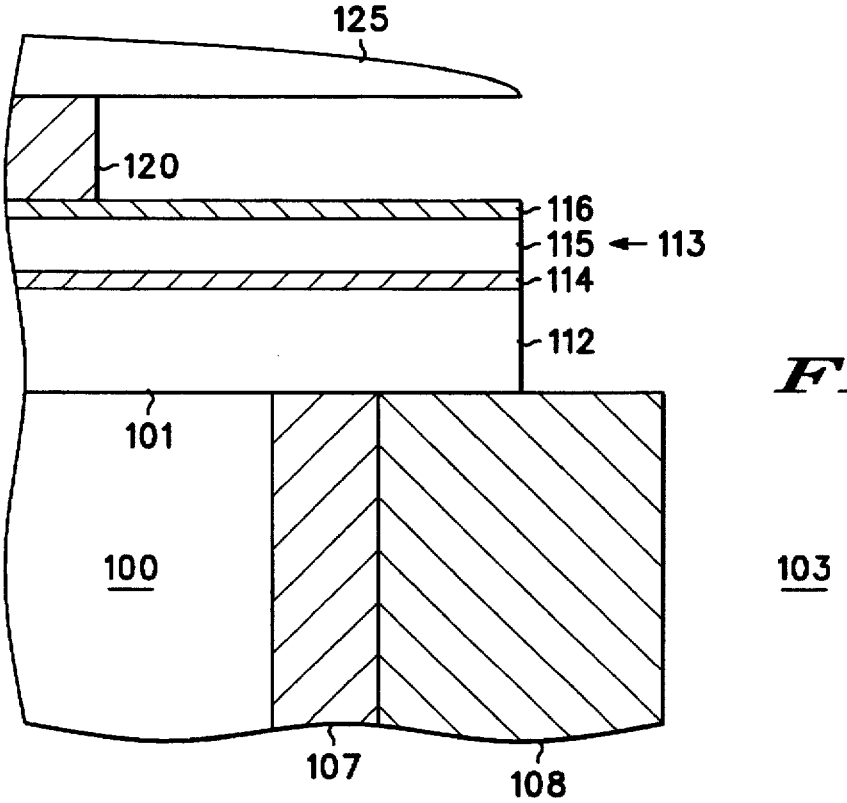

As illustrated most clearly in FIG. 11 and greatly enlarged FIG. 12, a layer 121 of photoresist, or other masking material, is formed on the surface of conductive layer 120 and conductive layer 120 is preferentially etched to remove at least the overhang. Layers 113 and 112 are then etched, or otherwise operated on to remove at least the overhang, as illustrated in FIG. 13 and greatly enlarged FIG. 14. A second layer 125 of photoresist, or other masking material, is formed on the surface of conductive layer 120 and layer 120 is preferentially etched back (setback) a sufficient distance to form a generally centrally located conductive lead for emitter 113, as illustrated in FIG. 15 and greatly enlarged FIG. 16. As will be explained in more detail presently, the reason for providing the setback in conductive layer 120 as illustrated in FIG. 16 is to provide a proper lateral ballast resistance between the final emitter lead (conductive layer 120) and an emitting surface of emitter 113.

Figure 17:
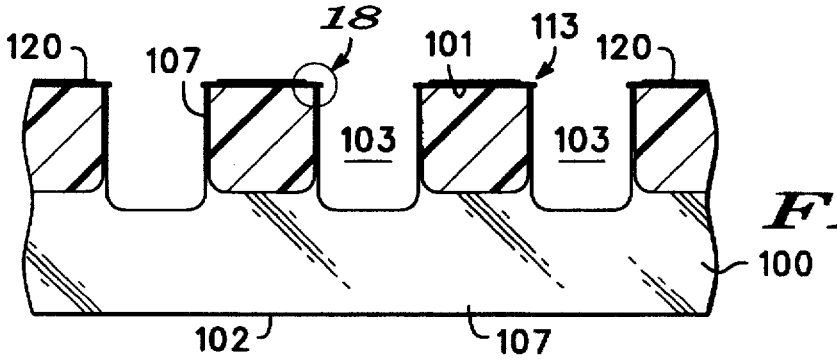
Figure 18:
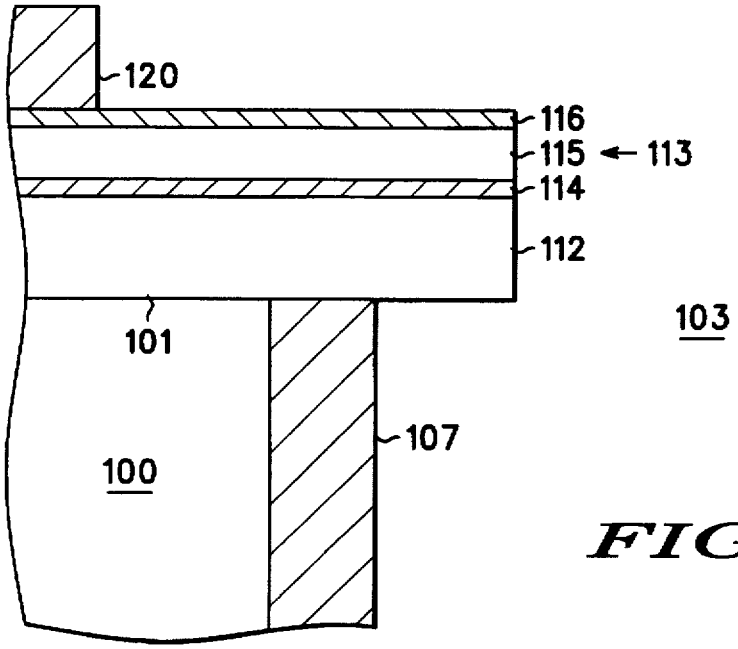

After conductive layer 120 is setback to the desired width, layer 125 is removed and sacrificial layer 108 is removed by some convenient method, such as etching or the like (depending upon the type of material used to form sacrificial layer 108). As illustrated in FIG. 17 and greatly enlarged FIG. 18, the removal of sacrificial layer 108 leaves layers 112 and 113 overhanging, or extending into groove 103. For proper operation of the edge field emitters, layers 112 and 113 are preferably clipped to a point at which they are flush with the outer edge of extraction gate layer 107. This can be accomplished utilizing any of a variety of techniques, as an example, the overhang can be abrasively polished, with a wet or gas abrasive slurry, directed through openings 105 from the direction of surface 101. The overhang might also be mechanically clipped with a tool inserted into slots 103 or masked and etched.

Figure 19:
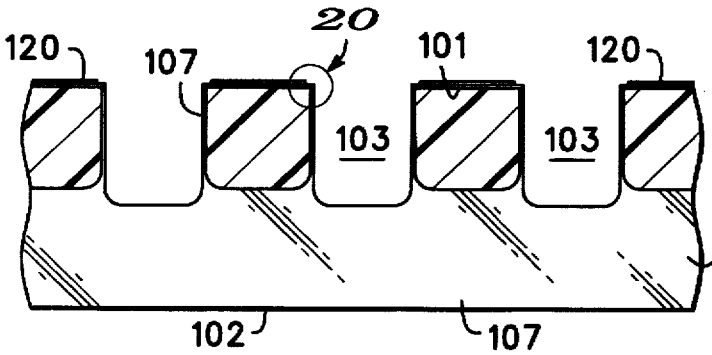
Figure 20:
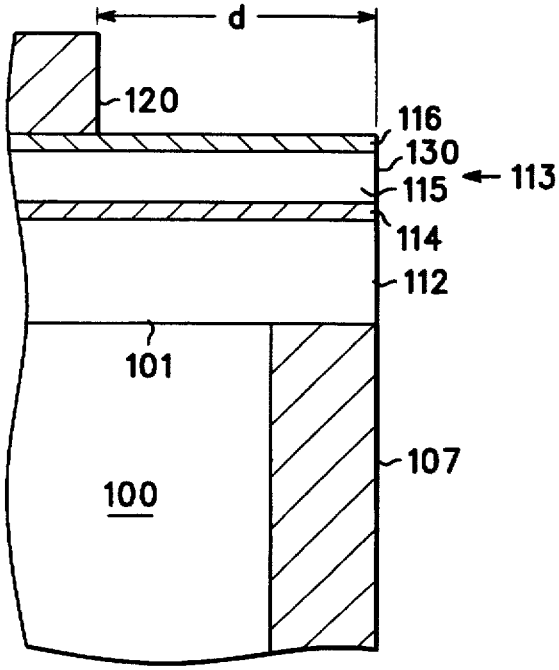

As shown in FIG. 19 and greatly enlarged FIG. 20, a surface 130 is formed on the outer edge of layer 115, facing groove 103 and spaced from extraction grid layer 107 by the width of spacing layer 112. Surface 130 is the edge, or surface, from which electrons are emitted into groove 103. Conductive layer 120 forms column connections to surface 130 with the portions of resistive material layers 114 and/or 116 between conductive layer 120 and surface 130 acting as a lateral ballast resistor. The prime determinants of the amount of resistance supplied by the ballast resistor are the material used as layers 112 and 116 and the distance "d" between layer 120 and surface 130.

Figure 21:
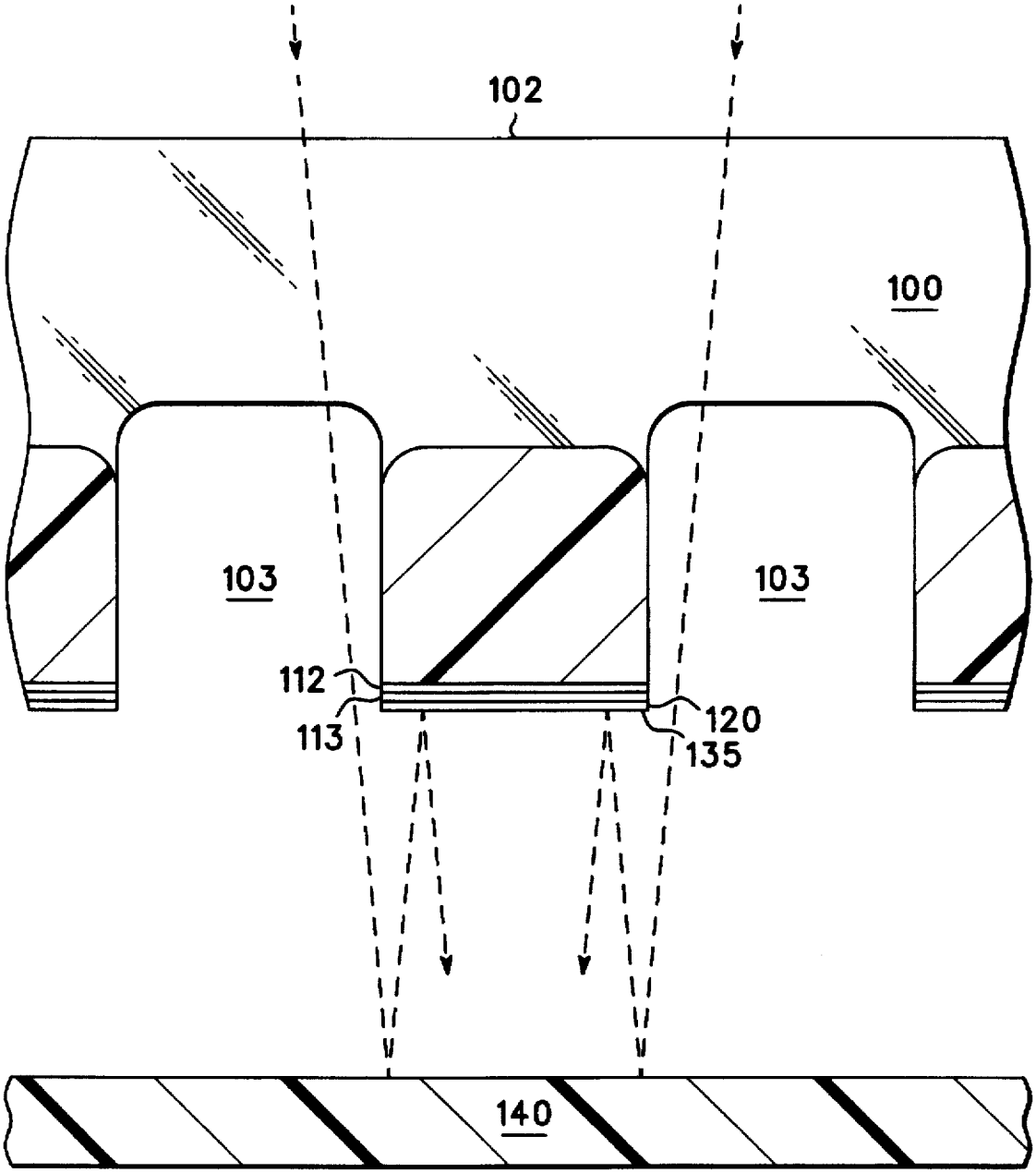
FIG. 21 is a schematic view illustrating the formation of a portion of an array of field emission devices in accordance with the present invention.

Referring to FIG. 21, a self-aligned patterning processes is disclosed for providing a setback in conductive layer 120. In this process, layers 107, 112, emitter 113 and conductive layer 120 are formed as described in conjunction with FIG. 10, or if desired FIG. 13. A positive photoresist layer 135 is provided on the surface of conductive layer 120 by some convenient method, such as roll coating or the like. A mirror 140 is positioned in parallel spaced relationship from surface 101 and photoresist layer 135 and a light is directed onto mirror 140 from side 102 of supporting substrate 100. The light shines through openings 105 and reflects back onto photoresist layer 135 but is masked sufficiently to expose only the edges of photoresist layer 135. In fact, it has been found that both edges of photoresist layer 135 can be exposed simultaneously with a normal exposure from an almost collimated light source. If the divergence angle of the light source is known, the spacing of mirror 140 from photoresist layer 135 to obtain a desired setback can be accurately calculated. The exposed portions of photoresist layer 135 are removed and conductive layer 120 is selectively etched using layer 135 as a mask.

Figure 22:
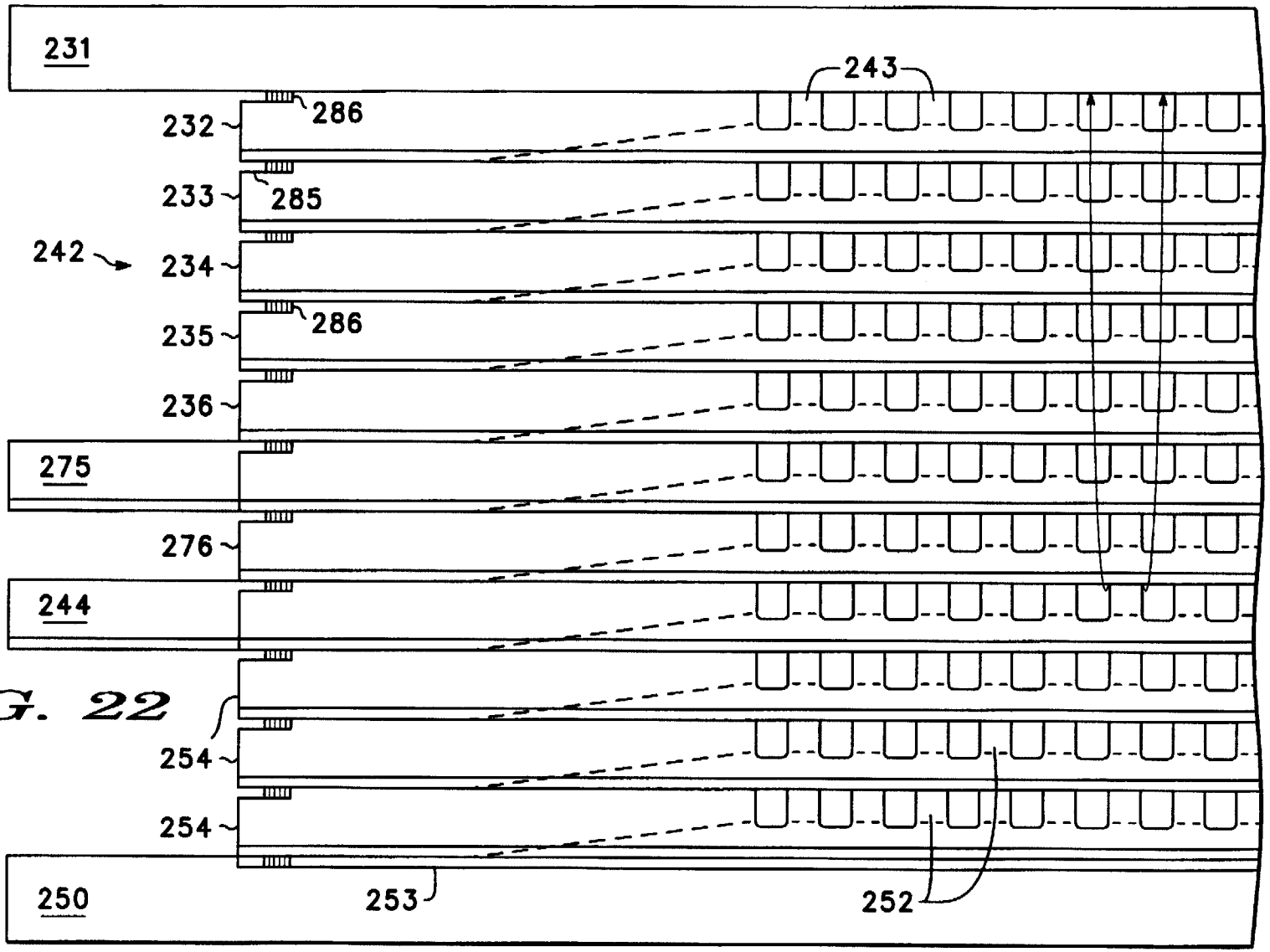
FIG. 22 is a cross-sectional view of a flat panel display in accordance with the present invention, portions thereof broken away.
Figure 23:
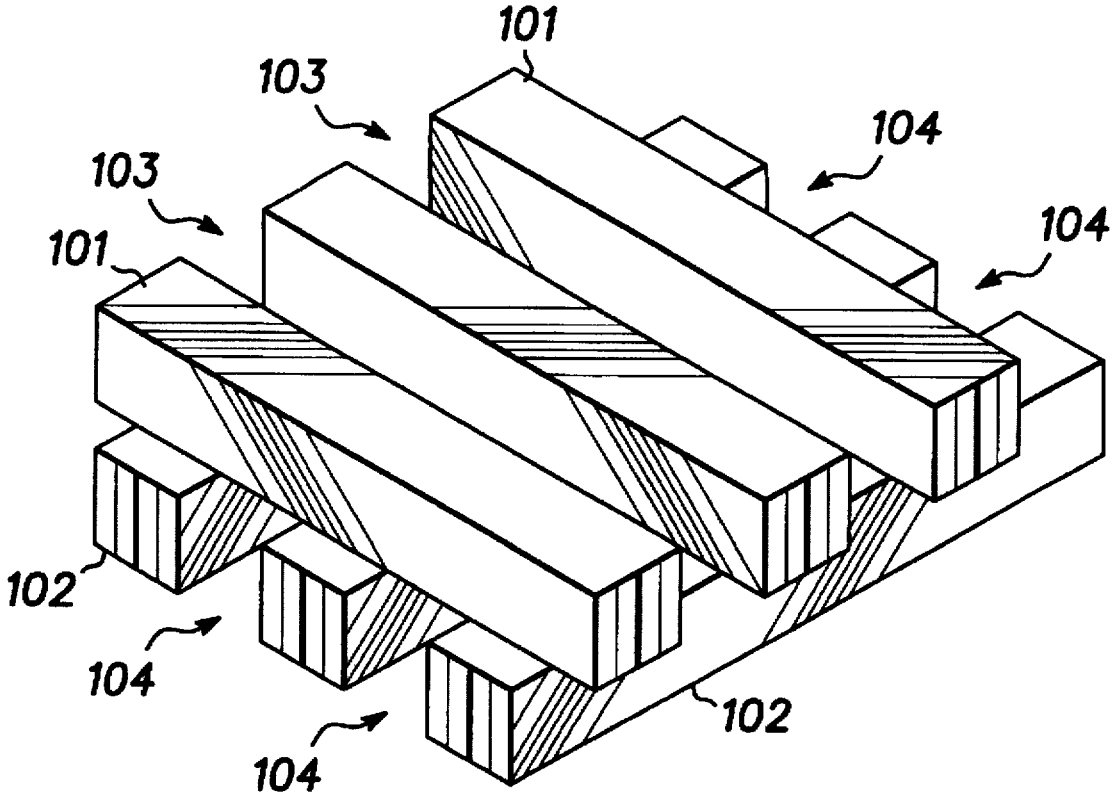
FIG. 23 is an isometric view of the supporting substrate of FIG. 3.

Referring specifically to FIG. 22, a cross-sectional view of a flat panel display 230 in accordance with the present invention is illustrated. A substantially optically transparent viewing screen assembly 231 includes a transparent screen having deposited thereon an energy conversion layer of material such as a cathodoluminescent material layer and a conductive anode layer, generally as previously described. An interspace insulating assembly 242 is formed by stacking substrates 232–236, similar to supporting substrate 100 described above, with the openings therethrough in axial alignment. The aligned openings through substrates 232–236 define interspace apertures 243. A supporting substrate 275, having a single conducting layer formed on a surface thereof (as described in conjunction with FIG. 2 above) is stacked on substrate 236 with the openings therethrough in axial alignment. A single substrate 276 is stacked on substrate 275 to serve as a spacer and a supporting substrate 244 (similar substrate 100 in FIGS. 19 and 20) is stacked on substrate 276 with the openings therethrough in axial alignment with all of the previous substrates. Supporting substrate 244 is processed as described above (e.g. FIGS. 19 and 20) to provide a two dimensional array of edge emitters thereon. A backplane 250 is distally disposed with respect to supporting substrate 244 and three substrates 254 are stacked together between substrate 244 and backplane 250 to form a spacer that defines an evacuated region 252 therebetween. A getter material layer 253 is disposed on backplane 250 in opposition to supporting substrate 244. The various substrates are sealed together and to screen assembly 231 and backplane 250 by some adhesive, such as a glass frit or the like.

Each of the stacking substrates 232–236, substrate 275 and 276, supporting substrate 244, and the three substrates 254 are stacked in abutting engagement for support against external (e.g. atmospheric) pressures when the internal cavities are evacuated. To ensure that a hermetic seal can be formed around the periphery between substrates, each substrate includes a rabbit joint 285 at opposite ends of and parallel with each set of grooves 103 and on the same side of the substrate and at opposite ends of and parallel with each set of grooves 104 and on the same side of the substrate. The rabbit joints are then filled with a hermetic sealant, glass frit in this embodiment, to seal the substrates in abutting engagement.

Thus, a new and improved supporting substrate for an array of edge emitting field emission devices is disclosed which is simple and inexpensive to fabricate and which greatly simplifies the process of manufacturing edge emitting field emission devices. Further, the new and improved supporting substrate allows an array of edge emitting field emission devices to be manufactured utilizing a completely self-aligning process, which further simplifies the manufacture and further reduces the cost. In addition, the new and improved supporting substrate allows the incorporation of ballasting resistors in the array of edge emitting field emission devices to provide uniform current distribution throughout the array. The new and improved supporting substrate can be conveniently stacked, similar to building blocks, to provide the required spacing and support for an array of edge emitting field emission devices.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A plurality of edge electron emitters for an array of field emission devices comprising:

a plate substrate having a first and a second planar surface positioned in parallel opposed relationship with a selected thickness therebetween;

a plurality of parallel, laterally spaced apart first grooves formed in the first planar surface and having a first depth, each of the first grooves having first side surfaces on opposite sides of and defining each of the first grooves and a plurality of lands positioned in the first planar surface, one each between adjacent first grooves;

a plurality of parallel, laterally spaced apart second grooves formed in the second planar surface and having a second depth, each of the second grooves having second side surfaces on opposite sides of and defining each of the second grooves, the second grooves being positioned so that each second groove crosses each first groove at an angle to the first grooves, the first and second depths combined being greater than the thickness of the plate substrate so that an opening is formed through the substrate at each area or region where a second groove crosses a first groove;

a layer of gate metal deposited on the second side surfaces of the plurality of second grooves and on the first side surfaces of the plurality of first grooves in each of the openings; and emitter material supported on each of the lands so as to form an edge emitter in conjunction with the layer of gate metal on the first side surfaces of the plurality of first grooves in each of the openings.

2. A plurality of edge electron emitters for an array of field emission devices as claimed in claim 1 wherein the layer of gate metal extends continuously along at least one of the second side surfaces of each second groove to form row conductors for the array.

3. A plurality of edge electron emitters for an array of field emission devices as claimed in claim 1 wherein the emitter material extends continuously along each land to form column conductors for the array.

4. A plurality of edge electron emitters for an array of field emission devices as claimed in claim 1 wherein the emitter material includes a layer of diamond-like carbon material.

5. A plurality of edge electron emitters for an array of field emission devices as claimed in claim 4 wherein the emitter material further includes layers of electrically resistive material positioned on each side of the layer of diamond-like carbon material.

6. A plurality of edge electron emitters for an array of field emission devices as claimed in claim 4 wherein the emitter material further includes a layer of metal overlying one of the layers of electrically resistive material.

7. An array of field emission devices comprising:

a plate substrate having a first and a second planar surface positioned in parallel opposed relationship with a selected thickness therebetween;

a plurality of parallel, laterally spaced apart first grooves formed in the first planar surface and having a first depth, each of the first grooves having first side surfaces on opposite sides of and defining each of the first grooves and a plurality of lands positioned in the first planar surface, one each between adjacent first grooves;

a plurality of parallel, laterally spaced apart second grooves formed in the second planar surface and having a second depth, each of the second grooves having second side surfaces on opposite sides of and defining each of the second grooves, the second grooves being positioned so that each second groove crosses each first groove at an angle to the first grooves, the first and second depths combined being greater than the thickness of the plate substrate so that an opening is formed through the substrate at each area or region where a second groove crosses a first groove;

a layer of gate metal deposited on the second side surfaces of the plurality of second grooves and on the first side surfaces of the plurality of first grooves in each of the openings, the layer of gate metal extending continuously along at least one of the second surfaces of each second groove and forming row conductors for the array;

emitter material supported on each of the lands so as to form an edge emitter in conjunction with the layer of gate metal on the first side surfaces of the plurality of first grooves in each of the openings, the emitter material extending continuously along each land and forming column conductors for the array; and an optically transparent faceplate assembly spaced from the plate substrate and substantially parallel with the first and second surfaces, the face plate assembly including cathodoluminescent material and a conductive anode and positioned to receive electrons emitted by the emitter material.

8. An array of field emission devices as claimed in claim 7 wherein the emitter material includes a layer of diamond-like carbon material.

9. An array of field emission devices as claimed in claim 8 wherein the emitter material further includes layers of electrically resistive material positioned on each side of the layer of diamond-like carbon material.

10. An array of field emission devices as claimed in claim 9 wherein the emitter material further includes a layer of metal overlying one of the layers of electrically resistive material.

* * * * *